US006001057A

United States Patent [19]

Bongiovanni et al.

[11] Patent Number: 6,001,057

[45] Date of Patent: Dec. 14, 1999

[54] SELF-CONTAINED ISOLATION AND ENVIROMENTAL PROTECTION SYSTEM

[75] Inventors: Richard Anthony Bongiovanni, Santa Ana; Peter Andrew Barnett, Costa Mesa; Douglas Ellwood Shultz, Brea, all of Calif.

[73] Assignee: Northrop Grumman Corporation, Los Angeles, Calif.

[21] Appl. No.: 09/048,768

[22] Filed: Mar. 26, 1998

[51] Int. Cl.[6] ..... A61G 10/00

[52] U.S. Cl. ..... 600/21

[58] Field of Search ..... 600/21, 22; 135/91, 135/92, 93

[56] References Cited

U.S. PATENT DOCUMENTS

| | | | |
|---|---|---|---|
| 1,200,852 | 10/1916 | Kern . | |
| 1,256,219 | 2/1918 | Freedman et al. . | |
| 1,258,694 | 3/1918 | Miller . | |
| 1,287,855 | 12/1918 | Brand . | |
| 1,473,862 | 3/1923 | Caswell et al. . | |
| 2,401,230 | 5/1946 | Colley . | |
| 2,704,989 | 3/1955 | Konecny . | |
| 2,837,778 | 6/1958 | Kern . | |
| 3,050,331 | 8/1962 | Mansen . | |
| 3,148,911 | 9/1964 | Boyer et al. . | |
| 3,348,245 | 10/1967 | Shindler | 5/82 |
| 3,376,059 | 4/1968 | Corl . | |
| 3,492,042 | 1/1970 | Nachtigall, Jr. . | |
| 3,531,151 | 9/1970 | Branfield . | |
| 3,678,921 | 7/1972 | Brendgord et al. . | |
| 3,729,002 | 4/1973 | Miller . | |

(List continued on next page.)

FOREIGN PATENT DOCUMENTS

| | | |
|---|---|---|
| PCT/AU95/ 00477 | 8/1995 | Australia . |
| 343077 | 11/1989 | European Pat. Off. . |
| 1373384 | 11/1962 | France . |
| 1416697 | 11/1972 | Germany . |
| 117 | of 1915 | United Kingdom . |

OTHER PUBLICATIONS

Buchanan Aircraft Corporation Engineered Composites (M.I.R.F.) Mobile Intensive Care Rescue Facility.
Spectrum Aeromed—Above and Beyond 1995.
MOBI—The Intensive Care Unit.
The Results of Innovation—Lifeport, Inc.
Mobile Intensive Care Rescue Facility (MIRF).
Aeromed Systems, Inc.—Specification/AMT 300.

*Primary Examiner*—Linda C. M. Dvorak
*Assistant Examiner*—R. Kearney
*Attorney, Agent, or Firm*—Terry J. Anderson; Karl J. Hoch, Jr.

[57] ABSTRACT

A self-contained isolation and environmental protection life support system for shielding a patient contained therein or, alternatively, isolating a contaminated patient from a clean environment while allowing treatment of traumatic injuries to the patient. The system comprises the combination of an environmental control system (ECS) and a containment enclosure that are designed to function in concert with conventional life support stretcher. The ECS component possesses an air management system that is designed and configured to extract contaminated particles and gas from the external air and deliver the same to the patient contained within the containment enclosure. To facilitate such delivery, the containment enclosure is preferably provided with a plurality of tubular passages which are designed to be filled with air provided by the ventilator system to thus cause the containment enclosure to expand to form a semi-rigid structure. A multiplicity of apertures formed upon the tubular passages that causes the purified air to pass therethrough and wash over the patient in a head-to-toe direction such that rapid removal of toxic residues is facilitated. The system further includes heating and cooling systems integrated into the ECS coupled with an environmental sensor to regulate attemporated air to a desired temperature depending on the conditions of the external environment.

15 Claims, 3 Drawing Sheets

U.S. PATENT DOCUMENTS 3,761,968 10/1973 Besler ..... 5/92
3,775,782 12/1973 Rice et al. ..... 5/82
3,840,265 10/1974 Stirling et al. .
4,023,219 5/1977 Shindler ..... 5/82
4,060,079 11/1977 Reinhold, Jr. .
4,161,172 7/1979 Pickering .
4,224,936 9/1980 Cox .
4,347,635 9/1982 Eisenhauer ..... 441/40
4,352,991 10/1982 Kaufman ..... 307/9
4,425,978 1/1984 Star .
4,485,806 12/1984 Akers .
4,584,989 4/1986 Stith .
4,680,790 7/1987 Packard et al. ..... 379/432
4,715,385 12/1987 Cudahy et al. .
4,724,844 2/1988 Rafelson .
4,747,172 5/1988 Hohol et al. ..... 5/507
4,757,811 7/1988 Clark .
4,768,241 9/1988 Beney ..... 5/60
4,780,919 11/1988 Harrison ..... 5/60
4,783,109 11/1988 Bucalo ..... 296/20
4,957,121 9/1990 Icenogle et al. ..... 128/897
4,981,139 1/1991 Pfohl .
5,005,230 4/1991 Congdon ..... 5/60
5,016,307 5/1991 Rebar ..... 5/503
5,020,546 6/1991 Russo .
5,034,181 7/1991 Billiu ..... 264/517
5,050,254 9/1991 Murphy ..... 5/82
5,063,924 11/1991 Galvan et al. .
5,077,843 1/1992 Dale et al. ..... 5/60
5,084,922 2/1992 Louit .
5,092,722 3/1992 Reazer, III et al. .
5,111,818 5/1992 Suzuki et al. ..... 128/644
5,117,521 6/1992 Foster et al. ..... 5/510
5,121,514 6/1992 Rosane ..... 5/628
5,173,142 12/1992 Billiu ..... 156/245
5,229,052 7/1993 Billiu ..... 264/115
5,236,390 8/1993 Young .
5,306,026 4/1994 Jesse ..... 280/18
5,307,818 5/1994 Segalowitz ..... 128/696
5,331,549 7/1994 Crawford, Jr. ..... 364/413.02
5,331,991 7/1994 Nilsson ..... 135/93
5,335,651 8/1994 Foster et al. .
5,338,588 8/1994 Billiu ..... 428/36.3
5,342,121 8/1994 Koria ..... 312/1
5,404,877 4/1995 Nolan et al. ..... 128/671
5,421,340 6/1995 Stanga et al. .
5,441,047 8/1995 David et al. ..... 128/670
5,474,574 12/1995 Payne et al. ..... 607/7
5,494,051 2/1996 Schneider, Sr. .
5,497,766 3/1996 Foster et al. .
5,511,553 4/1996 Segalowitz ..... 128/696
5,570,483 11/1996 Williamson ..... 5/83.1
5,590,648 1/1997 Mitchell et al. .
5,615,430 4/1997 Nambu et al. ..... 5/600
5,626,151 5/1997 Linden ..... 128/897
5,630,238 5/1997 Weismiller et al. ..... 5/600
5,664,270 9/1997 Bell et al. ..... 5/600
5,680,661 10/1997 Foster et al. ..... 5/618
5,687,717 11/1997 Halpern et al. .
5,853,361 12/1998 Kobayashi et al. ..... 600/21

Fig. 1
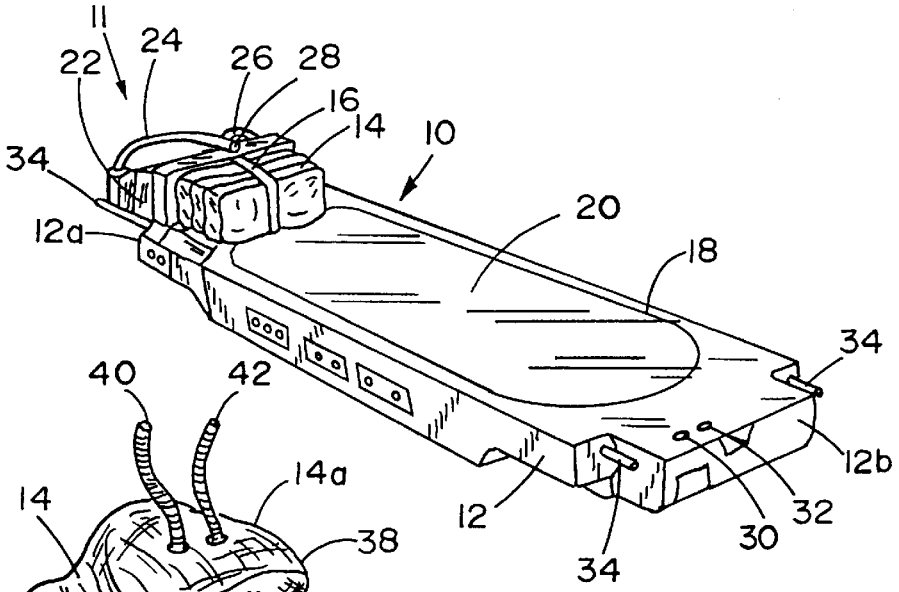
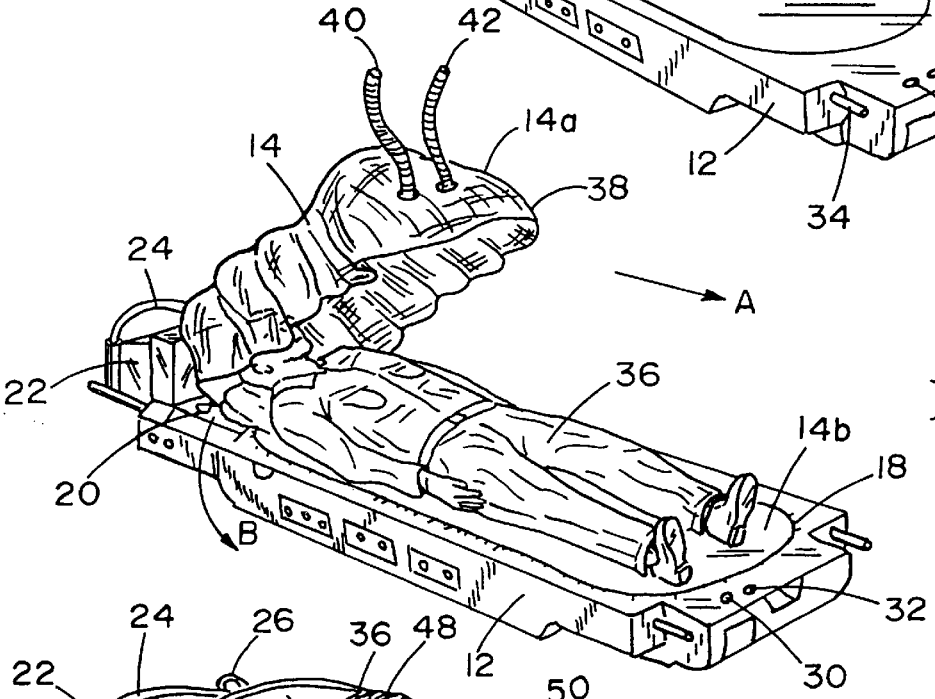
Fig. 2
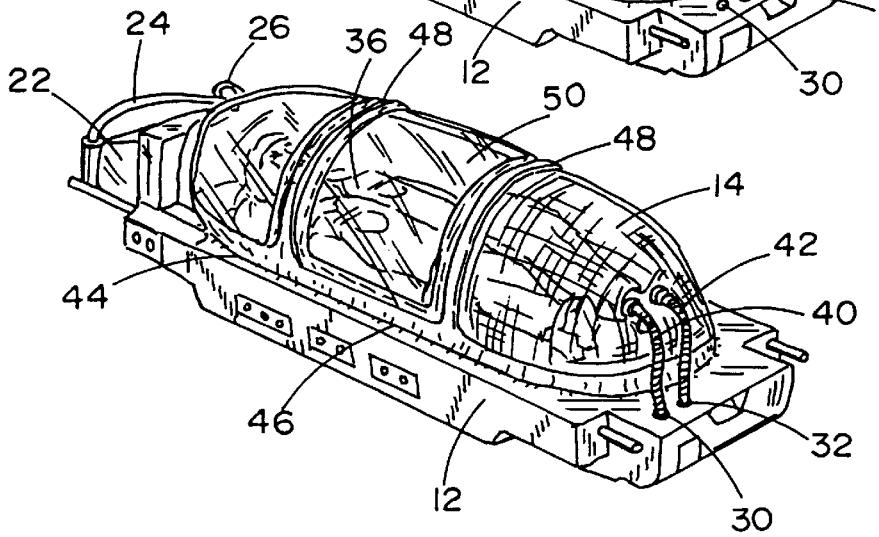
Fig. 3

SELF-CONTAINED ISOLATION AND ENVIROMENTAL PROTECTION SYSTEM

FIELD OF THE INVENTION

The present invention relates generally to medical devices utilized to isolate and treat intensive care patients outside of a medical facility, and more particularly, to a self-contained, transportable isolation and environmental protection system utilized in the resuscitation, stabilization, and transport of medical patients that further facilitates the isolation of the trauma casualty from a contaminated environment or a contaminated patient from a clean environment.

BACKGROUND OF THE INVENTION

Typically, when a person is injured and becomes a casualty in a contaminated environment, such as occurs in a chemical warfare confrontation, the casualty is taken to a decontamination site where he is decontaminated, and thereafter transferred to a medical treatment facility. In many cases, it is imperative that medical treatment be given to the casualty immediately.

However, in order to administer treatment, the casualty must first be isolated and transported into an enclosure within which medical personnel may work on the casualty or additional means must be provided for allowing access to the casualty without introducing contaminants into the enclosure containing the casualty. In this regard, it is desirable to isolate the patient from the environment when the environment-contains substances which may be detrimental to the medical patient. For example, if the patient has suffered severe blood loss or is experiencing difficulty breathing, then it is desirable to prevent the patient from breathing dust, engine exhaust, smoke, etc. It is also desirable to isolate the medical patient from the environment when bacteriological, chemical and/or radiological hazards are present, as may occur during battlefield conditions.

In addition, it would be advantageous if such isolated environment were caused to facilitate the removal of such toxic and infectious residues that may be present on the clothing and/or skin of such isolated medical patient to thus enable the patient to become further stabilized during transit to a suitable medical facility. Ideally, the isolated medical patient would be contained within an environment that is provided with air that is constantly circulated, decontaminated and refreshed such that such toxic and infectious residues are rapidly removed from the isolated medical patient's containment area.

Alternatively, it is desirable to isolate the caregivers from the medical patient in instances where the medical patient is suspected of having a contagious disease, or has been exposed to bacteriological, chemical or radiological contamination. As such, it is desirable to provide means for isolating the patient from the environment and caregivers, as well as isolating the caregivers from the patient.

Unfortunately, prior art apparatuses currently available for isolating and treating the casualty in the field are generally ineffective in providing an environment conducive to the administration of medical treatment, and can thus cause treatment to be delayed until the casualty is transported to an adequate medical facility, which is frequently not readily accessible. Such prior art apparatuses are further generally deficient in providing an environment where the casualty is protected from contaminants, and provided with refreshed, decontaminated air that actually facilitates the removal of contaminants already present on the skin and/or clothes of the casualty, in addition to providing trauma casualty treatment.

As such, there is a need in the art for an isolation system within which a medical patient is placed at the battlefield and within which the medical patient remains isolated until a suitable medical facility can be accessed. It is further desirable to provide an isolation system that can protect a medical patient contained therewithin from an contaminated external environment such that the condition of such patient is not made worse by the ingress of poisonous substances resulting from chemical and/or biological attack, as well as other harsh and extreme weather conditions arising from rain, wind, dust, hot, cold, wet and dry climatic conditions. There is still further a need for an isolation system that is capable of delivering a constant supply of air to a patient contained therewithin wherein such air is constantly circulated, decontaminated, refreshed, and selectively attemporated, that is further capable of delivering such air in a manner that facilitates rapid removal of toxic and infectious residues present upon the patient, and subsequently filters and decontaminates the same. There is additionally a need for a medical patient isolation system that is specifically designed and configured to function integrally with conventional litters and certain life support systems utilized therewith, most notable of the latter being the Life Support for Trauma And Transport device developed by Northrop Grumman Corporation and disclosed and claimed in co-pending U.S. Pat. application Ser. No. 08/687,693.

SUMMARY OF THE INVENTION

The present invention specifically addresses and alleviates the above-mentioned deficiencies associated with the prior art. More particularly, the present invention comprises a self-contained isolation and environmental protection system for the transportation of a patient from the battlefield or a scene of an accident to a hospital. The system comprises the combination of a patient containment enclosure and environmental control system (ECS) that are designed and configured to interconnect with a conventional litter and life support system utilized therewith, and in particular Northrop Grumman's Life Support for Trauma and Transport (LSTAT), such that there is delivered to the patient a constant supply of circulated, decontaminated and refreshed air that is prevents the further contamination of the patient or caregivers while facilitating trauma treatment.

The ECS is designed and configured to take air from the surroundings, extract contaminated particles and gas from the air by filtration, and force the resultant purified air to the patient, via the containment enclosure. The ECS is further designed to attemporate the air provided to the containment enclosure, and may further include an environmental conditioning unit that conditions, namely heats, cools, and/or dehumidifies the air as may be desired. In this regard, the environment conditioning unit is preferably coupled to an environment sensor that can selectively control environmental conditions. There is further preferably provided a filter to remove biological, chemical, and radiological contamination from the breathing air, once expelled.

The containment enclosure of the ECS preferably comprises a covering positionable about the casualty or medical patient when the latter assumes a supine position upon the litter with which the system of the present invention is used. The containment enclosure comprises the combination of a first lower bag portion and a second upper bag portion that are designed and configured to mate with one another via a long zippered opening to form an airtight, an anti-leak chamber. Formed about the upper bag portion are a series of tubular gas passages designed and configured to receive pressurized gas from the ECS such that when the tubular gas passages are filled with a pressurized gas supplied thereby, the upper bag portion assumes a semi-rigid, parallel piped structure.

Formed upon the interior of such tubular passageways are a plurality of apertures oriented to deliver a constant stream of air to the patient contained therewithin. In a preferred embodiment, the plurality of apertures are so formed upon the tubular structures of the cover such that as air is delivered, it is washed over the patient in a head-to-toe direction such that rapid removal of toxic and infectious residues is facilitated. To facilitate the passage of air through the chamber in such a manner, there is formed upon one end of the bag an outlet or exhaust valve designed to draw air delivered into the bag out therefrom in a proximal to distal direction.

The containment enclosure component of the system of the present invention is preferably fabricated from chemical and/or biochemical resistive materials that are further capable of protecting a patient contained therewithin from harsh and extreme weather conditions arising from rain, wind, dust, hot, cold, wet and dry climatic conditions. The bag component is further preferably fabricated from a transparent material to enable the patient contained therewithin to be viewed by medical personnel, as well as to minimize patient claustrophobic experiences. To facilitate medical treatment, the containment enclosure may further preferably provided with patient access means, preferably in the form of a flexible hand sock-type portals mounted upon the containment enclosure that is strategically positioned for complete patient access. Ideally, such portal system is designed to be left hand/right hand independent and designed to maximize the provider's hand manipulative abilities and finger functioning dexterity. The enclosure component of the system of the present invention is further preferably configured to assume a small, compact space when collapsed so that the same may be easily stored and transported, but may be readily deployed when necessary to form a closure about a patient.

It is therefore an object of the present invention to provide an isolation and environmental protection system for protecting a patient from a toxic or infectious environment, and protecting the caregiver from a contaminated patient, while facilitating the use of a life support system, namely the LSTAT, to perform trauma care, that further provides the patient with filtered, decontaminated air that may be selectively attemporated or conditioned to desired parameters.

Another object of the present invention is to provide an isolation and environmental protection system for protecting a patient from a toxic or infectious environment that is capable of delivering refreshed air to the patient contained therewithin.

Another object of the present invention to provide an isolation and environmental protection system for protecting a patient from a toxic or infectious environment that further protects the patient against harsh and extreme weather conditions arising from rain, wind, dust, hot, cold, wet and dry climatic conditions.

Another object of the present invention is to provide an isolation and environmental protection system for protecting a patient from a toxic or infectious environment that facilitates the rapid removal of toxic and infectious residues present upon the person contained therein.

Another object of the present invention is to provide an isolation and environmental protection system for protecting a patient from a toxic or infectious environment wherein such system is self-contained and specifically designed and configured to accommodate, fit within and be carried by a variety of military transport vehicles and aircraft.

Another object of the present invention is to provide an isolation and environmental protection system for protecting a patient from a toxic or infectious environment that allows a patient contained therewithin to be viewed by medical personnel and allow such medical personnel to quickly and easily access the patient's body when contained and enclosed therein.

A still further object of the present invention is to provide an isolation and environmental protection system for protecting a patient from a toxic or infectious environment wherein such system is simple to operate, may be readily utilized, and is sufficiently durable to withstand harsh environmental and/or battlefield conditions.

BRIEF DESCRIPTION OF THE DRAWINGS

These, as well as other features of the present invention, will be more apparent from the following description and drawings. It is understood that changes in the specific structure shown and described may be made within the scope of the claims without departing from the spirit of the invention.

FIG. 1 is a perspective view of a containment enclosure and ECS constructed in accordance with a preferred embodiment of the present invention shown in a pre-packaged, collapsed configuration contained within a transportable life support system in combination with a life support stretcher;

FIG. 2 is a perspective view of a patient assuming a supine position upon the litter with the containment enclosure and ECS of the present invention being deployed thereabout;

FIG. 3 is a perspective view of the patient of FIG. 2 fully contained within the containment enclosure of the present invention having a secondary component of the ECS shown coupled therewith;

DETAILED DESCRIPTION OF THE PREFERRED EMBODIMENT

Figure 4:
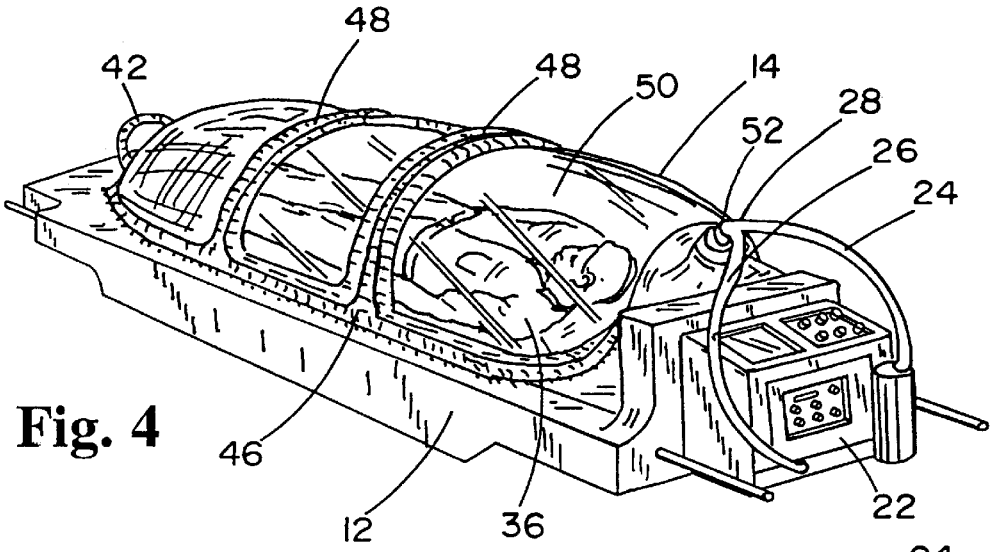
FIG. 4 is a rear perspective view of the patient, containment enclosure, and life support system of FIG. 3, wherein there is further depicted an ECS shown coupled to said containment enclosure.

The description set forth below in connection with the appended drawings is intended as a description of the presently preferred embodiment of the invention, and is not intended to represent the only form in which the present invention may be constructed or utilized. The description sets forth the functions and the sequence of steps for constructing and operating the invention in connection with the illustrated embodiment. It is to be understood, however, that the same or equivalent functions may be accomplished by different embodiments that are also intended to be encompassed within the spirit and scope of the invention.

Although discussed and illustrated herein as having particular application in battlefield situations, those skilled in the art will appreciate that the containment enclosure of the present invention may be utilized in various different civilian applications, such as emergency rescue and medical evacuation, especially where the emission or production of poisonous gasses or particles contaminate the surrounding and where people in or close to the area of the emergency or catastrophe require immediate degassification and treatment. As such, the terms medical patient, patient and casualty as used herein are defined to include patients and/or victims of any accident and/or medical condition resulting in the need for emergency medical care.

Referring now to the drawings, and initially to FIG. 1, there is shown a self-contained isolation and environmental protection system 10 comprised of the combination of a life support stretcher or litter 12 and a patent containment enclosure and environmental control system 11 connectible therewith for the transportation of a patient from the battlefield or a scene of an accident to a hospital. In this regard, it is contemplated that the system 10 of the present invention is specifically designed to configure to the utilized with certain battlefield life support systems, and in particular, the Life Support Trauma and Transport System (LSTAT) developed by Northrop Grumman Corporation, as disclosed and claimed in co-pending patent application Ser. No. 08/667,693, the teachings of which are expressly incorporated herein by reference.

As shown, the litter 12 is configured to have a proximal end 12*a* and a distal end 12*b* and an upper platform surface 20 upon which a medical patient may be placed, usually in a supine position. The external configuration of the litter 12 is further preferably designed to fit within and be carried by a variety of military transport vehicles and aircraft such as UH-60 Blackhawk helicopter, the UH-1 Huey helicopter, the HMMWV, the C-130 winged aircraft and/or the C141 fixed wing aircraft. Such configuration is further compatible with standard NATO litter mounts such that the system 10 of the present invention may simply be carried aboard such military evacuation vehicles in the same manner that a standard NATO stretcher having a battlefield casualty disposed thereupon is carried. To facilitate the transport of such litter 12, the same is typically provided with retention members 34 extending from the proximal and distal ends thereof.

The ECS 11, which is attachable to the litter 12 component of the system 10 of the present invention, is designed to take air from the surroundings, extract contaminated particles and gas from the air by filtration, and compress and force the resultant purified air into an enclosure formed about the patient via the bag component 14 thereof, discussed more fully below. The various components comprising the ECS 11, shown schematically in FIG. 7, advantageously provide means for maintaining a selectively controlled environment independent of the external surroundings. Such selectively controlled environment, as provided and maintained by the ECS, and more particularly the components thereof discussed more fully below, is further designed to provide filtered and decontaminated air to the patient ventilator enclosed within the system should the patient require the same. To provide means for selectively controlling the ECS 11, a control circuit 22 is provided and is coupled to such system to thus enable the user to regulate the operation thereof.

Mounted upon the litter 12, and preferably formed as a component of the ECS 11 is an containment enclosure 14 constructed in accordance to a preferred embodiment of the present invention. The containment enclosure 14 is preferably designed and configured to assume a first collapsed, packaged configuration, as shown, and preferably is packaged within the ECS 11 (as shown in phantom) via strap 16. The containment enclosure 14 is fabricated from those materials resistive to chemical and/or biological attack, namely, poisonous gasses or lethal bacterial agents used in the battlefield, or in the unintentional emission of poisonous substances. The containment enclosure 14 is further fabricated from those materials well-known in the art that can withstand harsh and extreme weather conditions arising from rain, wind, dust, hot, cold, wet and dry climatic conditions. It will be further appreciated that such containment enclosure 14 will preferably be fabricated from transparent materials so that in use, the patient 36 contained therein, depicted in FIGS. 3 and 4, may be visually observed by medical personnel. Additionally, by providing a transparent containment enclosure 14, the patient 36 contained therein is less likely to experience a claustrophobic event insofar as such individual will be able to see his or her surroundings.

Referring now to FIG. 2, there is shown the containment enclosure 14 as deployed over a casualty 36, the latter assuming a supine position upon the platform surface 20 of the litter 12. As illustrated, the containment enclosure 14 is comprised of two parts, namely, a lower bag portion 14*b* and an upper bag portion 14*a*. Both bag portions 14*a*, 14*b* are extended from the proximal end 12*a* of the litter 12 in the direction indicated by the letter A. As will be appreciated, in order for the casualty 36 to assume such position within the containment enclosure 14, it will first be necessary to extend the lower bag portion 14*b* upon the platform surface 20 with the upper bag portion 14*a* then being extended over the patient 36 toward the distal end of the litter to form a canopy over the patient 36.

To enable the upper and lower bag portions 14*a*, 14*b* to form an air-tight seal with one another, there is formed about the respective peripheral edges thereof respective sets of teeth 18, 38 that cooperate to form a leak-proof, zipper-like closure. In this respect, the containment enclosure 14 is provided with a slide fastener 20 that, when advanced in the direction indicated by the letter B about the patient, causes the respective teeth 18, 38 to mate with one another and form the air-tight seal 44 shown in FIG. 3.

As additionally shown as a detached component of the system 10 of the present invention there is preferably provided a second component 26 of the ECS 11 which is designed to be mounted upon litter 12, and more particularly the distal end 12*b* thereof, that is designed and adapted to interconnect with inlet hose 29 and outlet hose 42 via dedicated ports, such as 26*a*. The secondary component 26 is further provided with an outlet valve 32 designed and adapted to interconnect with valve 30 formed on the distal end 12*c* of the litter 12 to facilitate the recirculation of air delivered to the patient 36, discussed more fully below.

The containment enclosure 14 is further provided with a bezel 52, shown in FIG. 4, to which air inlet nozzle 28 interconnects therewith. As will be recognized by those skilled in the art, air inlet nozzle 28 is coupled with the control circuit 22 to thus enable the latter, either automatically or by user control, to direct the flow of air passing therethrough and into the containment enclosure 14.

Referring now to FIG. 3, the containment enclosure 14, and more particularly the upper bag portion 14*a* thereof, is shown in an inflated state. In this respect, horizontal peripheral edge 46 and ribs 48 extending therefrom are formed as tubular gas passages formed by flexible inner tubes conformably connected to one another which are encased within the material of the upper bag portion 14*a*. Such material may be formed out of a flexible plastic material which may be either heat sealed or sewn around the tubular portions 46, 48, and is preferably formed of a material which is impermeable to any contaminates which are expected to be found in the environment in which the containment enclosure 14 are to be used. In an alternative embodiment, the tubular gas passages 46, 48 are formed integrally with the upper bag portion 14*a*.

Figure 5:
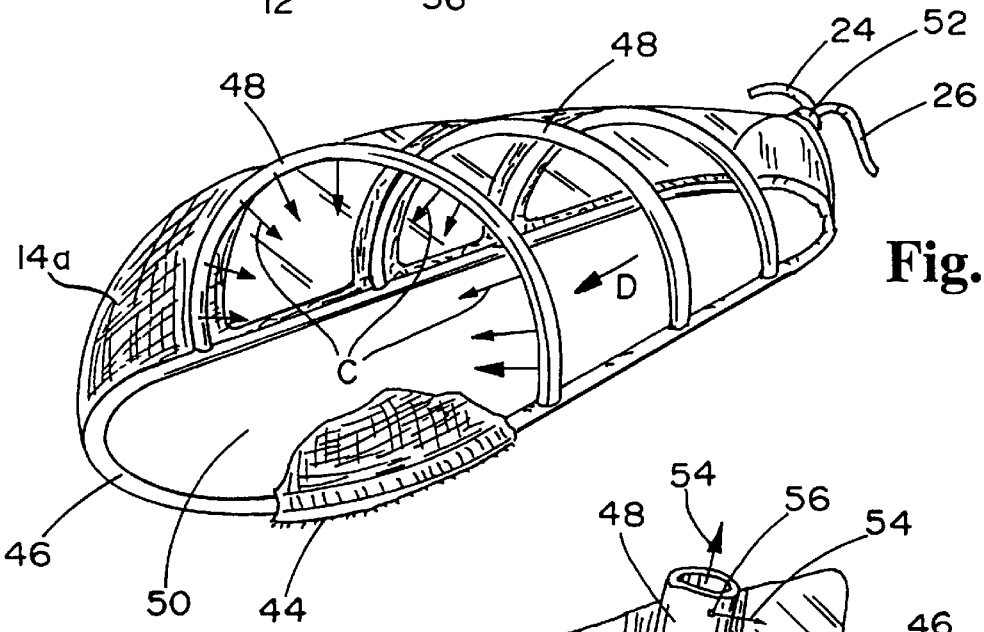
FIG. 5 is a perspective view of the containment enclosure of the present invention indicating the flow of air delivered within the interior portion thereof as distributed by tubular gas passages formed thereon.

As illustrated in FIG. 5, air is caused to be passed through the tubular passageways 46, 48 via a duct, which preferably takes the form of a bezel connection 52. As will be recognized by those skilled in the art, the gas passages 46, 48 are coupled to the bezel 52 in such a manner that air passing through bezel connection 52 causes such passageways to become inflated to form a semi-rigid structure that defines a chamber or capsule 50 that isolates the medical patient 36.

Figure 6:
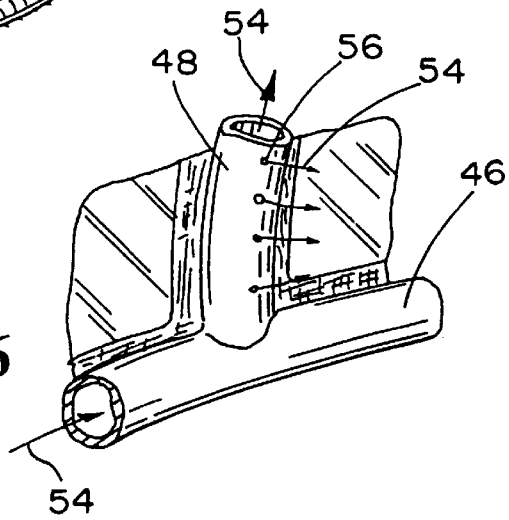
FIG. 6 is a perspective view of a portion of the tubular gas passageway formed upon the containment enclosure of the present invention depicting a plurality of apertures through which is shown the direction of a flow of air.

The air is ultimately delivered radially inward about the chamber 50 defined by the inflated containment enclosure 14, as indicated by the letter C. As shown in greater detail in FIG. 6, the path of air 54 that is passed about horizontal peripheral tubular passageway 46 flows upwardly through lofting support rib passageway 48 and eventually flows through a plurality of apertures 56 formed thereon. As those skilled in the art will appreciate, such inward radial flow of air about the chamber 50 causes the patient contained therewithin to be thoroughly washed with such refreshed air. Furthermore, air pressure contained within the lofting air passages creates an outwardly supporting structural framework for the patient enclosure.

Once the air has been washed about the patient 36, the same is recycled by the ECS, via outlet hose 42 or the like connection formed on the distal end of the containment enclosure 14. In this regard, outlet hose 42 is connectable to an exhaust port formed upon the secondary component 26 of the ECS 11, the latter being coupled with a fan situated within the ECS to thus draw air from the proximal end of the containment enclosure 14 to the distal end thereof, shown as the direction D in FIG. 5, and discussed more fully with respect to FIG. 7.

By directing the air forced into the chamber 50 to be drawn from the proximal end to the distal end thereof thus causes the same to wash over the patient in a head-to-toe flow direction. As those skilled in the art will appreciate, air washing over the contaminated patient in such a manner advantageously provides chemical drying for rapid removal of toxic residues on clothing and skin which, once removed from the chamber 50 and into the outlet hose 42 and valve 32 of the ECS 11, are filtered and decontaminated through an air recycle system of the ECS 11. Moreover, bathing the patient in air in such a manner eliminates dead air pockets and $CO_2$ buildup which thus facilitates uniform heating, cooling and humidity control.

Figure 7:
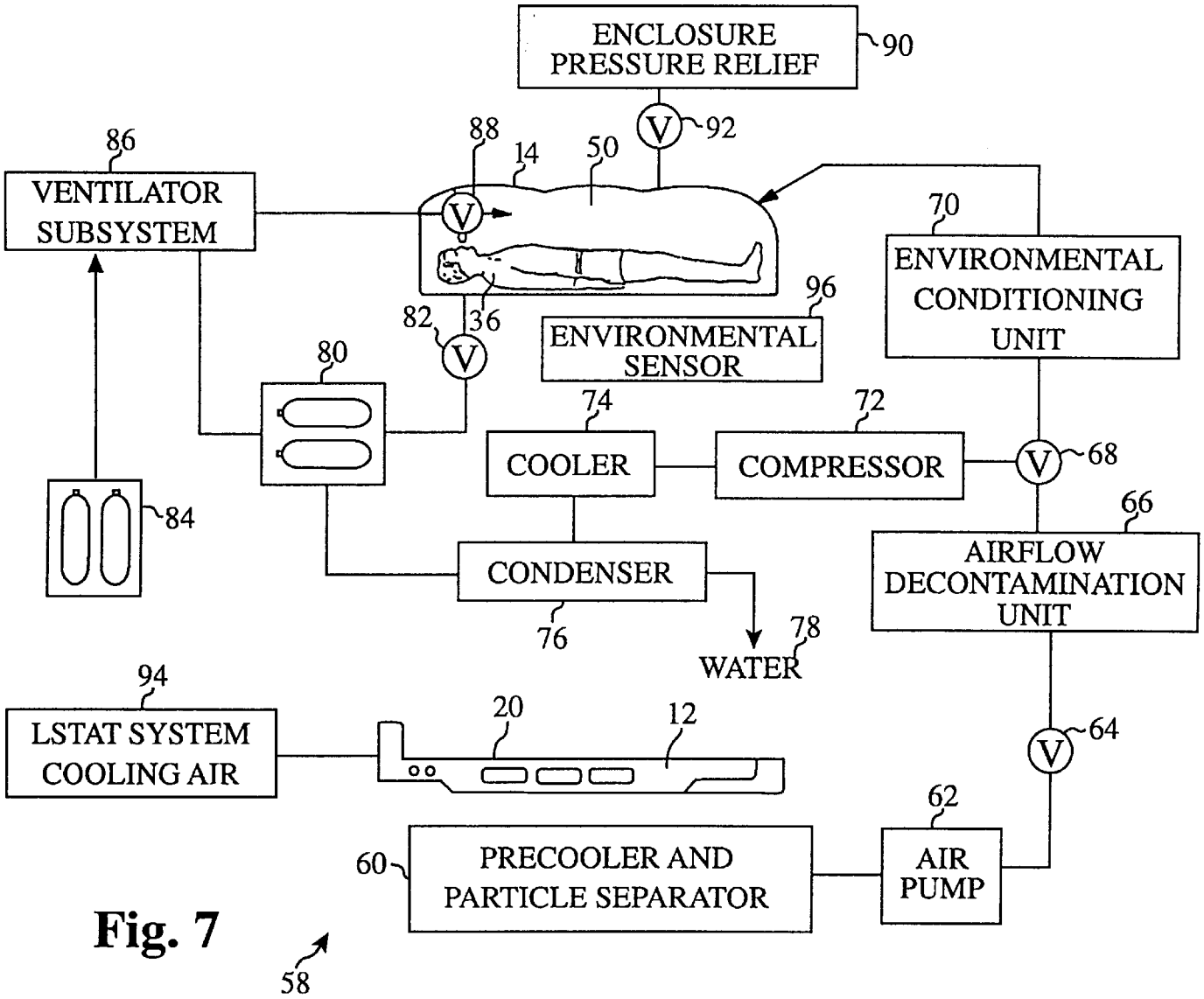
FIG. 7 is a schematic diagram of the components of the environmental conditioning system integrated into the isolation and environmental protection system of the present invention.

Referring now to FIG. 7, there is shown the various components comprising the ECS 11 of the present invention and their respective interconnection to one another to provide and maintain a selectively controllable environment to a given patient 36 isolated therewithin. As will be recognized, the various components shown in FIG. 7 may preferably be either partially or completely integrated into the life support stretcher 12 and beneath the upper platform surface 20 upon which the patient 36 is ideally positioned. Additionally, as illustrated in FIGS. 2 and 3, certain components, and in particular, secondary component 26 of the ECS 11, may be selectively attachable directly upon the upper platform surface 20.

As illustrated, the ECS 11 includes a particle separator 60 into which air is drawn in, via fan 64 from the external environment and filters the same to remove contaminating particles therefrom. Disposed intermediate the filter 60 and fan 64 is a check valve 62 which selectively controls the rate of air passing therebetween. The air received by fan 64 is then routed to either one of two directions, namely, either to ventilator subsystem 66 or to air pump 80, the latter causing the air received thereby to be passed through one of two heat exchangers, 82, 84 which are provided to either heat or cool the air passing therethrough. Thereafter, the air is then fed through inlet hose 29, also depicted in FIGS. 2, 3, and 5 for recirculation to the patient 36. In this respect, the air is fed to inlet hose 29 via the secondary component 26 of the ECS 11, as shown in FIGS. 2 and 3, is caused to distribute about the tubular passageways 46, 48 formed about the enclosure.

Alternatively, all or a portion of the air flowing from fan 64 may be fed to a ventilator subsystem 66. In this regard, as such ventilator subsystem may preferably take the form of those ventilator subsystems disclosed in co-pending U.S. Pat. application Ser. No. 08/687,693. From such ventilator 66, the air is then caused to pass into the containment enclosure 14, via the tubular passageways 46, 48 thereof. In this respect, it should be recognized that the air flowing from the ventilator subsystem 66 into the tubular passageway 46, 48 will be accomplished via the connection between the air inlet valve 28 and bezel 52 formed upon the containment enclosure 14, as depicted in FIG. 4.

Once the air is distributed about the patient as described with reference to FIG. 5, the same is then extracted through outlet hose 42. In this regard, air is drawn from the outlet hose 42 via a second fan 70. The air drawn therethrough is caused to pass through a second filter 68 which advantageously filters and removes contaminating particles present upon the person contained within the enclosure 14. Air received by the fan 70 may then either be expelled, through check valve 72 or, alternatively, may be fed to a de-humidifier 74 which may remove excess moisture 76 from the air that is recirculated through the system. The air may then be fed through another check valve 78, provided to control the rate of air passing therethrough, and then passed into air pump 80 for recirculation within the containment enclosure 14.

As discussed above, the air provided by both inlet valve 28 and inlet hose 29 is radially delivered to the patient 36 contained within containment enclosure component 14. Such delivery causes the bag 14 to inflate and form chamber 50 such that air is washed over the patient 36. As will be recognized, such delivery of air to the patient 36 causes the containment enclosure component 14 to be positively pressurized, i.e., pressure above ambient, which advantageously isolates the patient 36 from caregivers and/or the environment. Such positive pressurization causes air to leak therefrom, which is selectively controlled by the outlet valve 72 of the ECS 11. Advantageously, by filtering and treating the air both as it delivered to and withdrawn from the chamber within which the patient 36 is isolated, such patient 36 is protected from the external, contaminated environment. Likewise, the caregivers are protected in such situations where the patient 36 is contaminated insofar as any toxic substances or contagions that would remove from or otherwise be expelled by the patient 36 is filtered and isolated via second filter 68, such that the caregivers are not subjected to the same.

As will be recognized, each of the components comprising the ECS 11 will be coupled to a control circuit integral to the ECS (not shown) that will regulate the operation thereof. To prevent over-heating of the components comprising the ECS system 11 during operation thereof, there may further preferably be provided a cooling air system (not shown) designed to circulated cooled air within the litter 12 when the ECS 11 is in use. Such system 11 may further be coupled to an environment sensor (not shown) to sense and/or regulate environmental conditions within the patient containment area. Such conditions may include temperature, light, pressure, humidity, as well as other environmental conditions. Thus, for example, environmental sensor may be operative to sense chemical and/or bacterial conditions within the housing, and to implement air filtration functions to deplete any chemical, biological contaminants. In this respect, such air filtration functions are normally implemented on a continuous basis in order to assure that the environmental conditions within the housing remain isolated from environmental conditions external to the housing.

With respect to operation of the system 10 of the present invention, such operation comprises the steps of removing the containment enclosure 14 from its collapsed, packaged condition and charging the bottom portion of the containment enclosure 14 across the litter 12, and attaching the bezel 52, being an integral part thereof, to the patient circuit interface 22 of the life support stretcher 12, the latter providing access to the ventilator subsystem 66 via inlet valve 28. The patient is then positioned thereupon. As will be recognized, to the extent additional medical devices, tubes, wiring and the like are to be deployed, the same are passed into the containment enclosure opening, through the bezel 52 and from the patient circuit interface 22 and connected to the patient positioned thereupon.

Thereafter, the fastening device 20 is slid about the peripheral edges of the upper and lower bag portions to form an air-tight seal. Environmental and decontamination systems contained within the ECS 11 are then activated with air being purified and passed from the ECS 11 to the containment enclosure by way of the tubular passageways 46, 48 thereof. Air will thus flow over the patient in the head-to-toe manner discussed above.

While in such isolated state, the patient may be transported via conventional means and, upon arrival at a suitable medical facility, may be treated as necessary. To that end, the ECS 11 need only be turned off and the sealable closure opened to thus gain access to the patient. Although not shown, the containment enclosure 14 of the present invention may further be provided with patient access means, which may comprise a flexible hand sock-type portal which is formed upon the containment enclosure 14 and strategically position for complete patient access. Such portal system, as those skilled in the art will appreciate, is preferably designed to be left hand/right hand independent and designed to maximize the care provider's hand manipulative abilities and finger functioning dexterity. Following use of the containment enclosure 14, the same may be discarded or, alternatively, decontaminated, sterilized and repackaged for reuse.

Although the invention has been described herein with specific reference to a presently preferred embodiment thereof, it will be appreciated by those skilled in the art that various additions, modifications, deletions and alterations may be made to such preferred embodiment without departing from the spirit and scope of the invention. Accordingly, it is intended that all reasonably foreseeable additions, modifications, deletions and alterations be included within the scope of the invention as defined in the following claims.

What is claimed is:

1. A self-contained isolation and environmental protection system for protecting a medical patient from a contaminated environment comprising:

a) a body capsule attachable to a litter having an interior compartment for receiving and isolating said medical patient, said body capsule comprising first and second bag portions interconnectable to one another that cooperate to form said interior compartment, said body capsule further having a fastener for fastening said first and second bag portions to one another for opening and closing said body capsule and respectively exposing or isolating said interior compartment from said contaminated environment, said body capsule being formed from a material substantially impermeable to vapor fumes and contagions present in the surrounding external environment;

b) an Environmental Control System (ECS) for providing decontaminated, conditioned and refreshed air;

c) an interface formed upon said body capsule for coupling and interconnecting with said ECS; and d) a passageway formed upon said body capsule fluidly connected to said ECS for receiving air therefrom, said passageway having at least one inwardly-facing aperture formed thereon such that when said passageway is supplied with air provided by said ECS, said air is caused to pass through said aperture and into said interior compartment of said body capsule.

2. The system of claim 1 wherein said ECS comprises:

a) an apparatus for receiving air from the external surroundings;

b) a filter for extracting contaminating particles and gas from said air received from said external environment; and c) an apparatus for passing said filtered and decontaminated air into said body capsule.

3. The system of claim 2 wherein said ECS is designed and configured to deliver said air in a manner so as to establish a predetermined air pressure which is higher than the external ambient air pressure.

4. The system of claim 2 wherein said ECS further includes an apparatus for attemporating the air delivered to said body capsule to a predetermined temperature.

5. The system of claim 4 wherein said system further comprises:

d) an environmental sensor coupled to said apparatus for attemporating said air temperature for selectively controlling the predetermined temperature to which said air is attemporated.

6. The system of claim 2 wherein said ECS further comprises a source of conditioned and filtered air and means for distributing said air to a ventilator subsystem provided in said litter.

7. The system of claim 1 further comprising:

a) a pressure relief system coupled to said body capsule, said pressure relief system being designed and configured to release a portion of said air delivered to said body capsule and filter and decontaminate a portion of said air delivered to said body capsule.

8. The apparatus of claim 1 wherein said passageway for receiving pressurized air comprises a plurality of tubular gas passageways fluidly connected to one another such that when said plurality of tubular passageways are supplied with pressurized air, said body capsule assumes an expanded position to form a semi-rigid structure.

9. The apparatus of claim 1 wherein said passageway has a plurality of inwardly facing apertures formed thereon, said plurality of apertures being designed and configured to deliver and distribute air into said interior compartment of said body capsule.

10. The apparatus of claim 1 wherein said apparatus is designed and configured to assume a first collapsed configuration for facilitating the transport and storage thereof, and a second expanded configuration when in use.

11. The apparatus of claim 1 wherein said body capsule further includes an exhaust valve formed thereon for allowing pressurized air delivered to said interior compartment to pass therefrom.

12. The apparatus of claim 11 wherein said body capsule is formed to have proximal and distal ends such that when said medical patient is contained within the interior compartment thereof, the head of said medical patient is oriented toward said proximal end and the feet and legs of said medical patient are oriented toward said distal end, said exhaust valve being formed upon said distal end of said body capsule such that when pressurized air is delivered to said interior compartment, said air is caused to expel toward said distal end of said body capsule.

13. The apparatus of claim 1 wherein said body capsule is sized and adapted to assume a first collapsed position and a second expanded position when said capsule is in use for providing access to said medical patient.

14. The apparatus of claim 1 wherein said body capsule is formed from a transparent material.

15. The apparatus of claim 1 wherein said body capsule has a window formed thereon to allow visual examination of said interior compartment from said external environment.

* * * * *